United States Patent [19]

Kondo et al.

[11] 4,408,552

[45] Oct. 11, 1983

[54] APPARATUS FOR AUTOMATICALLY PRODUCING COMFORTERS

[76] Inventors: Atsushige Kondo; Masakazu Kondo, both of 1126 Oaza Gamou, Yanagawa-shi, Fukuoka, Japan

[21] Appl. No.: 108,989

[22] Filed: Jan. 2, 1980

[30] Foreign Application Priority Data

Mar. 15, 1978 [JP] Japan ..... 53-30049
Jul. 14, 1979 [JP] Japan ..... 54-75399

[51] Int. Cl.[3] ..... D05B 11/00; D05B 21/00
[52] U.S. Cl. ..... 112/119; 112/121.12
[58] Field of Search ..... 112/117, 118, 119, 102, 112/121.12, 121.11

[56] References Cited

U.S. PATENT DOCUMENTS 3,490,398 1/1970 Anniel ..... 112/102
3,960,095 6/1976 Story ..... 112/118
4,262,613 4/1981 Landoni ..... 112/121.12 X

*Primary Examiner*—Peter P. Nerbun
*Attorney, Agent, or Firm*—Jordan and Hamburg

[57] ABSTRACT

In this apparatus for automatically producing comforters, the feeding of the comforter materials through the apparatus in a longitudinal direction and the shifting of the frame structure which carries a plurality of sewing machines in a transverse direction are conducted by servo motors which are accurately controllable by a suitable control device such as a numerical control device. Due to such construction, the apparatus can accurately and readily stitch a desired and complicated pattern on the surface of the comforter.

8 Claims, 14 Drawing Figures

APPARATUS FOR AUTOMATICALLY PRODUCING COMFORTERS

BACKGROUND OF INVENTION

This invention relates to an apparatus for automatically producing a comforter, a bedquilt, a bed spread, and more particularly a comforter which has a desired stitch pattern on the surface thereof.

Conventionally, there have been devised several types of apparatuses for automatically producing comforters. In providing desired stitch patterns on the surface of the comforter, these apparatuses shift the material-feeding frame structure reciprocably in a transverse direction by a cam mechanism. However, the use of a cam mechanism inevitably gives rise to several problems, for example, the restriction of the number of patterns producible or the cumbersome replacing operation of the cams. Furthermore, the conventional apparatus provided with such cam mechanism cannot produce comfortors which have a complicated pattern on the surface thereof such as a closed pattern (e.g. a closed circle) or a discontinuous pattern.

It is an object of the present invention to provide an apparatus for automatically producing a comforter which can resolve the above-mentioned defects of conventional apparatuses.

It is another object of the present invention to provide an apparatus for automatically producing a comforter which can vary the feeding speed as well as reversing the direction of the comforter material, thus producing a comforter which can have a desired shape or pattern on the surface thereof.

It is still another object of the present invention to provide an apparatus for automatically producing a comforter which employs an NC (numerical control) device for the accurate control of the necessary drive mechanisms of the apparatus.

DETAILED DESCRIPTION OF THE DISCLOSURE

The apparatus of this invention is hereinafter disclosed in great detail in view of the apparatuses shown in the attached drawings.

Figure 1:
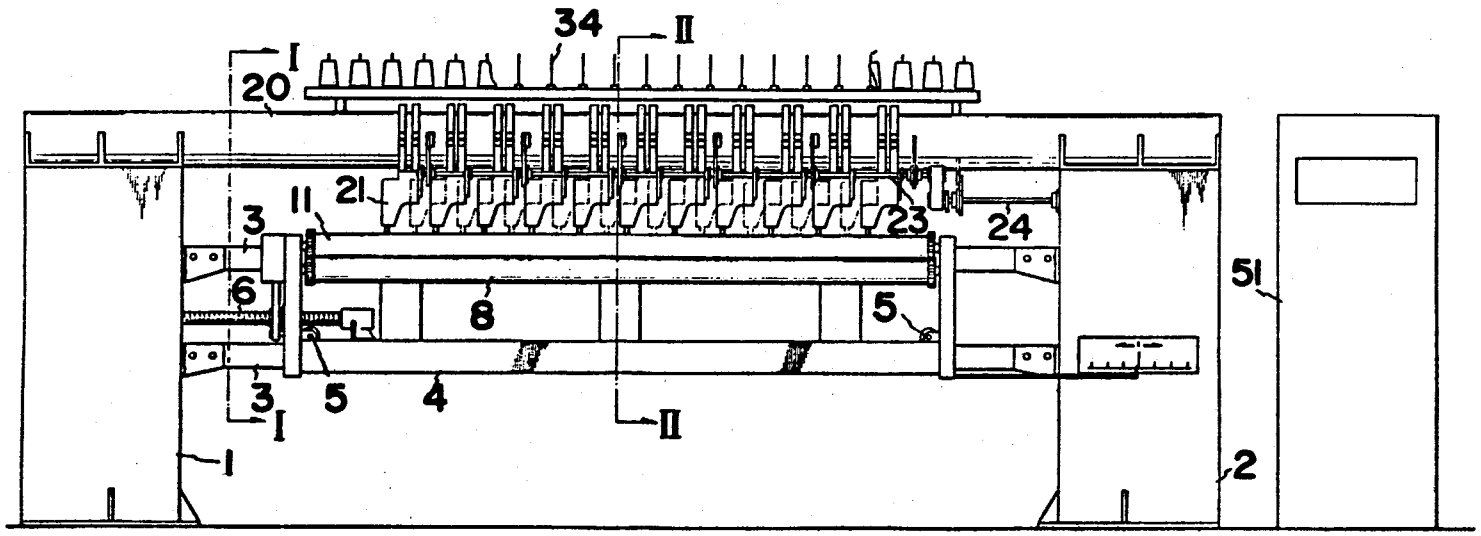
FIG. 1 is a front view of the apparatus of this invention.

In FIG. 1, two support structures (1) and (2) are firmly mounted on the floor in a parallely spaced-apart manner. The left-side support structure (1) encases a power drive mechanism which will be described later in detail. Guide rails (3) which have enough resistance against stress bridge the support structures (1) and (2). A movable frame structure (4) is slidably mounted on the guide rails (3) such that the frame structure (4) is reciprocably movable in a widthwise direction. For facilicating the smooth movement of the frame structure (4), the frame structure (4) is provided with guide wheels (5) attached to the widthwise ends of the frame structure (4). Numeral (6) indicates a threaded shaft which has the distal end operably meshed with the left-side end of the frame structure (4) and the proximal end connected to a servo motor (25) disposed within the left-side support structure (2). Due to such construction, when the threaded shaft (6) is rotated by the servo motor (25), the frame structure (4) moves in a widthwise direction along the guide rails (3) by means of the above operable thread engagement. A bearing (7) is mounted on the frame structure (4) for supporting the distal extremity of the threaded shaft (6) rotatably and in a slide-through manner.

Figure 4:
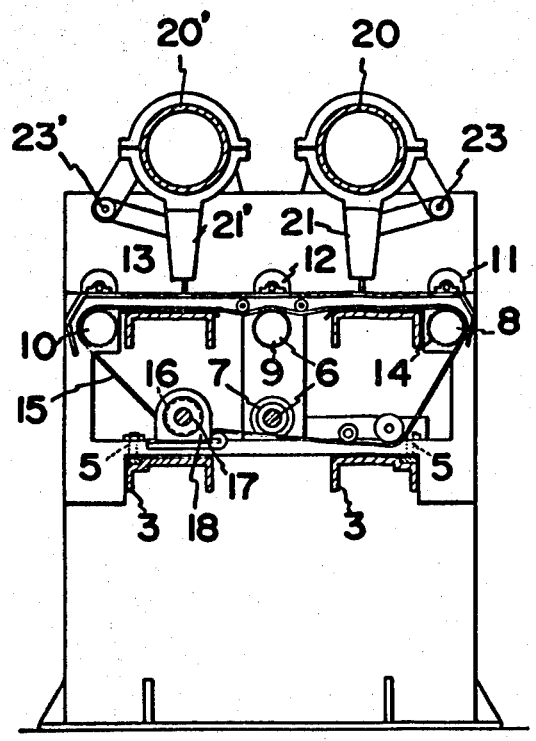
FIG. 4 is a transverse cross sectional view of FIG. 1 taken along the line I—I of FIG. 1.
Figure 5:
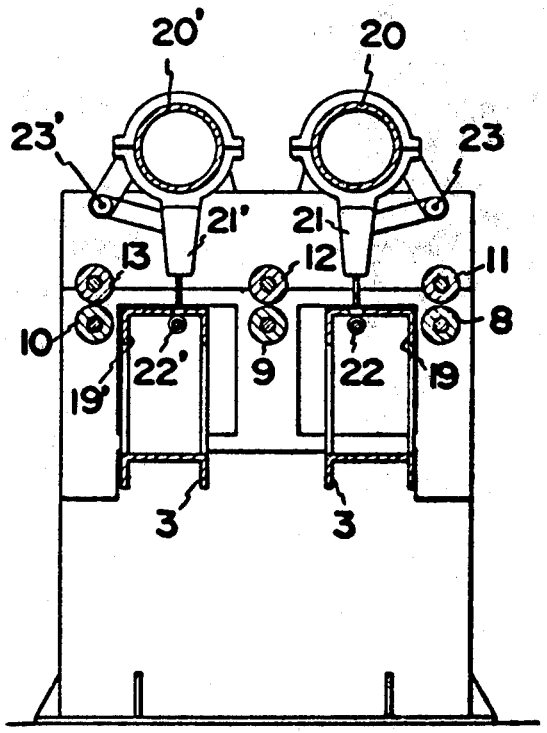
FIG. 5 is a transverse cross sectional view of FIG. 1 taken along the line II—II of FIG. 1.

Frame structure (4), as best shown in FIG. 4 and FIG. 5, is provided with three pairs of rollers which extend in a widthwise direction and are disposed in a parallely spaced apart relationship perpendicular to the comforter feeding direction, wherein the first pair comprises front lower and upper rollers (8) and (11), the second pair comprises intermediate lower and upper rollers (9),(12) and the third pair comprises rear lower and upper rollers (10) and (13). In the above construction, upper rollers (11), (12) and (13) form the pinch rollers. The frame structure (4) is further provided with a roller drive mechanism which integrally rotates the above rollers (8), (9), (10), (11), (12) and (13). The roller drive mechanism substantially comprises sprocket wheels (14) which are fixedly secured to one end of the respective lower rollers (8), (9) and (10), an endless chain (15) which operably connects a drive sprocket wheel (16) with the above three sprocket wheels (14), a drive shaft (17) which firmly carries the drive sprocket wheel (16) thereon and has the proximal end thereof connected with a power transmission sprocket (28) encased in the left-side support structure (1) and a bearing (18) which rotatably supports the distal end of the drive shaft (17).

The sewing machine mechanism, as can be best understood from FIG. 1, FIG. 4 and FIG. 5, is disposed above the movable frame structure (4) provided that the upper portions of the guide rails (3) also work as feed plates (19) for stitching.

Such sewing machine mechanism, besides the feed plate (19), includes a sewing-machine mounting pipe (20) which bridges between the support structures (1), (2), a plurality of sewing machines (21), bobbin cases

Figure 3:
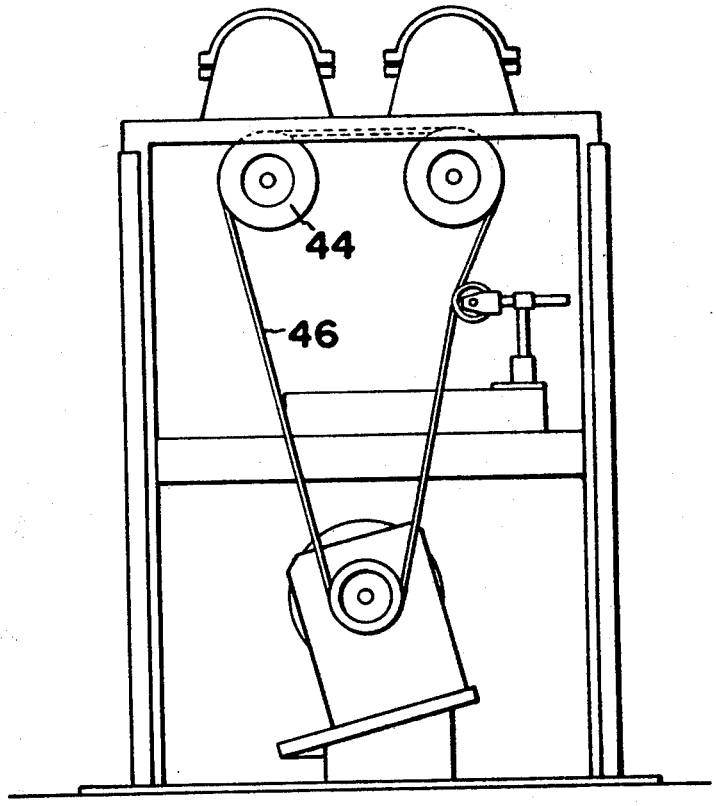
FIG. 3 is another side view of the above apparatus showing the inside of the right support structure.

(22) attached to the feed plates (19) for receiving the needles of the sewing machines (21), first transverse rotating shafts (23) provided for operating the sewing machines (21), and second transverse rotating shafts (24) and their proximal end connected to a power-operated motor (41) by way of pulleys (44) and an endless V belt (46). The power operated motor (41) is encased in the right support structure (2) as shown in FIG. 3, while a plurality of bobbin mounting shafts (34) are attached to the sewing-machine mounting pipe (20) as shown in FIG. 1.

Figure 2:
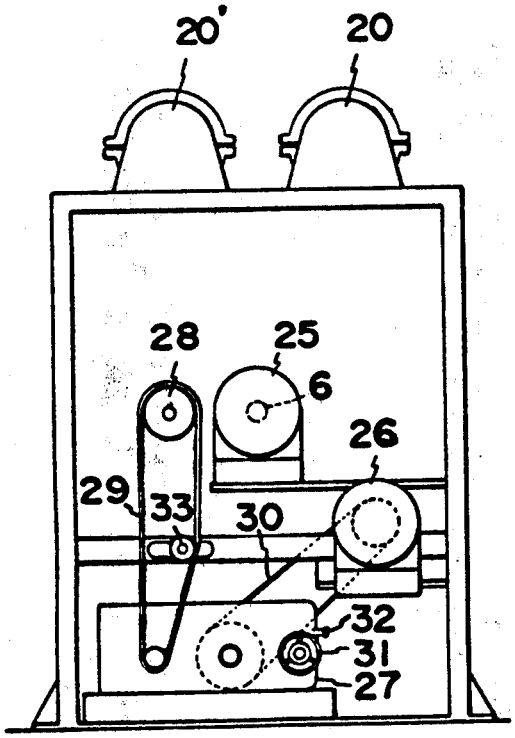
FIG. 2 is a side view of the above apparatus showing the inside of the left support structure.

As shown in FIG. 2, a frame operating mechanism is encased in the left support structure (1), wherein numeral (25) indicates a reversible servo motor which is operably connected with the threaded shaft (6) for shifting the frame structure in a desired transverse direction, numeral (26) indicates another reversible servo motor which is operably connected with the shaft (17) for driving rollers (8), (9), (10) in either forward or backward direction and numeral (27) indicates a non-step speed varying device which is employed for rotating the drive shaft (17) at a desired reduction rate relative to the rotating speed of the servo motor (26). Referring to the other elements of the frame operating mechanism, numeral (28) is a sprocket wheel fixedly secured to the end of the drive shaft (17), numeral (29) is an endless chain which operably connects the sprocket wheel (28) and the speed varying device (27), numeral (30) is an endless chain which operably connects the speed varying device (27) to the servo motor (26), numeral (31) indicates a speed varying ration controller provided with an auxiliary stopper means (32) and numeral (33) indicates an idler gear for tightening the endless chain (30).

Figure 6:
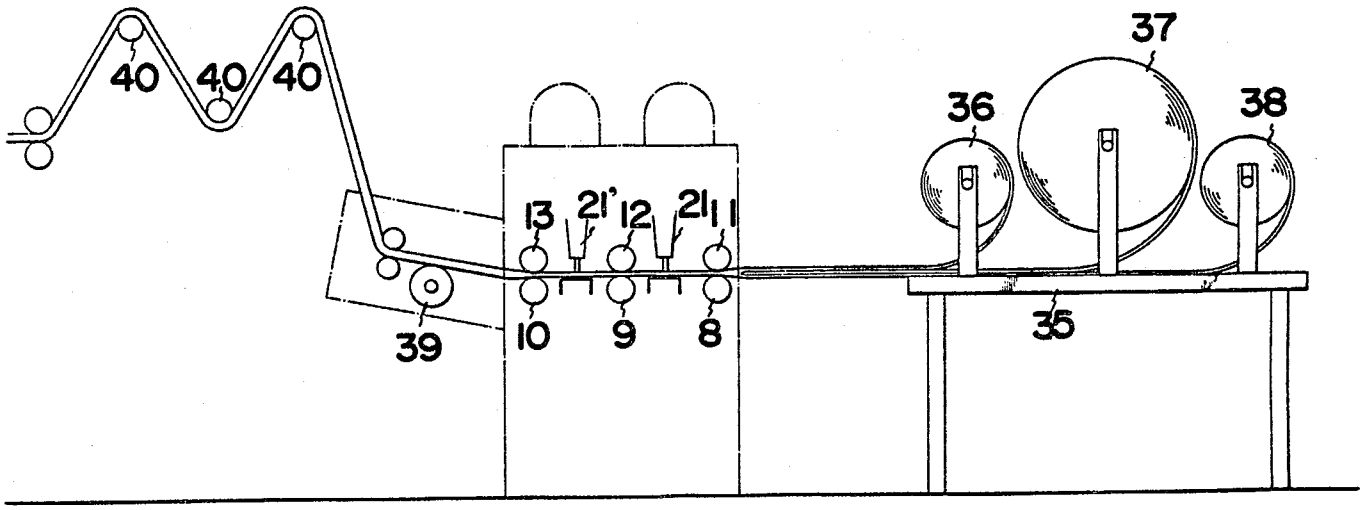
FIG. 6 is an explanatory view showing the comforter production line including the apparatus of this invention.
Figure 7:
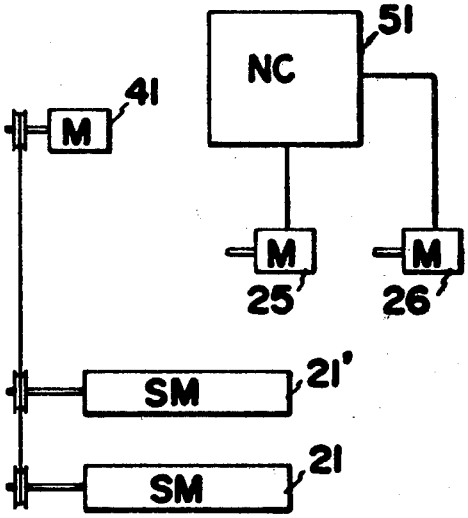
FIG. 7 is an explanatory view explaining the power connection of the drive mechanisms with the NC device.

In FIG. 6, the comforter production line is partially described, wherein the apparatus of this invention is shown in an imaginary line. A material reel mounting table (35) is disposed in front of the apparatus of this invention and is provided with a front cover supply reel (36), a cotton filling supply reel (37) and a backing cover supply reel (38) thereon, while behind the apparatus of this invention is disposed a shearing device (39) which cuts the comforters in a desired length. Numeral (40) indicates a plurality of transfer rollers which transfer the produced comforters to a desired location.

The manner in which the apparatus of this invention produces the comforters is hereinafter disclosed.

Before feeding the comforter material to the apparatus, the pattern to be stitched on the comforter is first designed using a multiple number of points or plots, each of which is designated by the x abscissa (widthwise direction) and y ordinate (feeding direction) on the X-Y coordinate with the plotted data then fed into the NC (numerical control) device (51) as input. Any type of NC device (51) is applicable in this invention. For example, "System 5M" produced by Fujitsu Fanuc Ltd. of Japan is considered as such an NC device (51).

In operation, the servo motors (25), (26) are both actuated in accordance with the output signal delivered from the NC device (51). Namely, following the data output delivered from the NC device (51), the servo motor (25) rotates in either direction in order to shift the movable frame structure (5) transversely while the servo motor (26) rotates in either direction in order to impart the desired rotation to the rollers (8), (9) and (10), which provides the feeding of the comforter material. Simultaneous with the above operation, the power-operated motor (41) begins to drive the plurality of sewing machines (21),(21') which perform the stitching operation. Due to the above simultaneous and cooperative operation of the servo motors (25), (26) controlled by the NC device (51) along with the actuation of the power-operated motor (41), the apparatus of this invention can automatically stitch a desired pattern on the surface of the produced comforter.

Figure 8A:
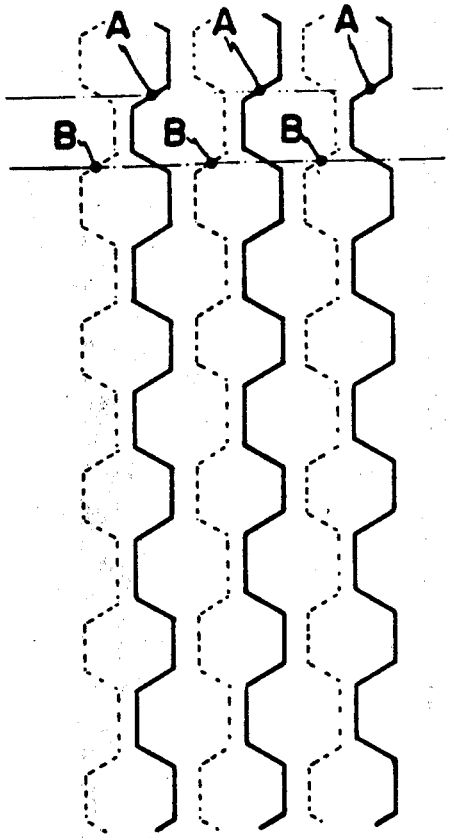
FIG. 8A and FIG. 8B are explanatory views showing patterns produced by the apparatus of this invention.

It is preferable that the apparatus be provided with two parallely-spaced-apart sewing-machine mounting pipes (20) to which sewing machines are mounted in an alternative manner. Such construction enables the apparatus to produce a stitched pattern shown in FIG. 8A which is impossible with an apparatus having a single sewing-machine mounting pipe (20). In FIG. 8A, the solid line indicates a pattern stitched by the sewing machine (21) on the front row (the front sewing-machine mounting pipe) and the dotted line shows a pattern stitched by the sewing machine (21') on the rear row (the rear sewing-machine mounting pipe). A indicates the needle position of the front-row sewing machine (21), while B indicates the needle position of the rear-row sewing machine (21').

Figure 8B:
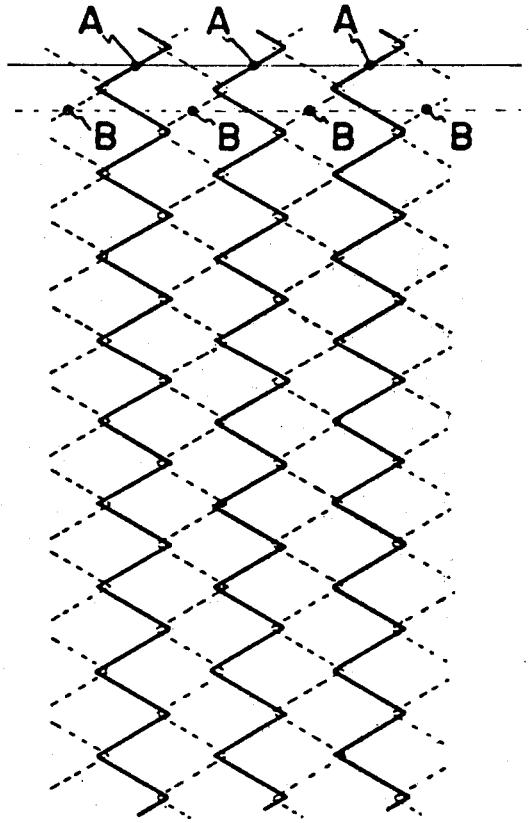

Although no problem may occur so long as the pattern to be stitched is simple, the tension imparted to the comforter by the rollers (8), (9) and (10) greatly influences the finished pattern when a complicated pattern is to be stitched. Namely, in stitching the latter pattern, since the comforter material between rollers (for example, between front lower roller (8) and intermediate lower roller (9) or between the intermediate lower roller (9) and the rear lower roller (10)) receives the tension or tensile force in a feeding direction (y direction in X-Y coordinate), the comforter greatly elongates depending on the nature of the material. Therefore, although during the stitching operation, the comforter may show a desired or predetermined pattern on the surface thereof, the finished product (comforter) which returns to a normal (tension-free) state shows a deformed pattern in a feeding direction, thus lowering the commercial value of the comforters as products. Furthermore, there may be a chance that when the apparatus is provided with two rows of sewing machines (21), (21') as previously mentioned, the crossing points of the patterns stitched by respective sewing machines (21), (21') may cause lag in a feeding direction as shown in FIG. 8B so that a desired pattern could not be produced.

As one of the measures for correcting the deformation of the pattern caused by the elongation of the comforter material, data may be prepared paying enough consideration to the elongation rate of the comforter material and such data may be fed into the NC device (51) as input. However, since the elongation rate will considerably vary dependent on the property or nature of each comforter material and also the position of the portion of the comforter material within the supply reel (for example, reel-out starting portion intermediate portion or reel-out finish portion of the comforter material reels (36), (37) and (38)), a great number of input data must be prepared dependent on the variation of the elongation so that such method is not generally suitable. Accordingly, in this invention, the non-step varying device (27) is interposed between the drive shaft (17) which actuates the rotation of the rollers (8), (9) and (10) and the servo motor (26) in order to adjust the feeding speed (or returning speed) of the comforter material corresponding to the elongation rate of the comforter material, while not touching upon the input signal to the servo motor (26). Accordingly, for example, when the elongation rate of the comforter material is 10%, the feed speed of the comforter material is increased by 10% relative to the basic or "control" feed speed by the manipulation of the speed varying device (27), whereby the finished product, after returning to a tension-free normal condition, can have a predetermined pattern on the surface thereof increasing the commercial value of the comforters as sales products.

As has been described heretofore, the apparatus of this invention has the following advantages.

(1) Since the apparatus requires no cam mechanism, the preparation and repairing of the cam which is a very cumbersome operation is eliminated.

(2) Coupled with the use of the NC device, the apparatus can stitch a very accurate pattern on the comforter.

(3) Since the NC device can accurately control the movement of the comforter material in the x direction and y direction, the apparatus now can stitch a complicated pattern, such as a flower pattern, a circular pattern or a discontinuous pattern (skipping pattern), all of which the conventional apparatus cannot stitch since the apparatus is merely provided with a constant-speed feeding system.

(4) In forming a pattern with the conventional apparatus, the pattern is stitched by shifting the comforter material in a widthwise direction while feeding the conforter material at a constant speed. Such operation inevitably produces the uneven or irregular distance between each two stitches. Whereas, in forming a pattern with the applicant's apparatus, the line speed (or stitching speed) can be made constant so that the distance between each two stitches is also constant or equal, whereby the comforter provided with an aesthetic pattern which has a high commercial value can be produced.

(5) Since the deformation of the pattern due to the elongation of the comforter material or lag in feed can be readily corrected, the comforter as produced will also show a high commercial value from this point of view as well.

MODIFICATION OF THE APPARATUS

Figure 9:
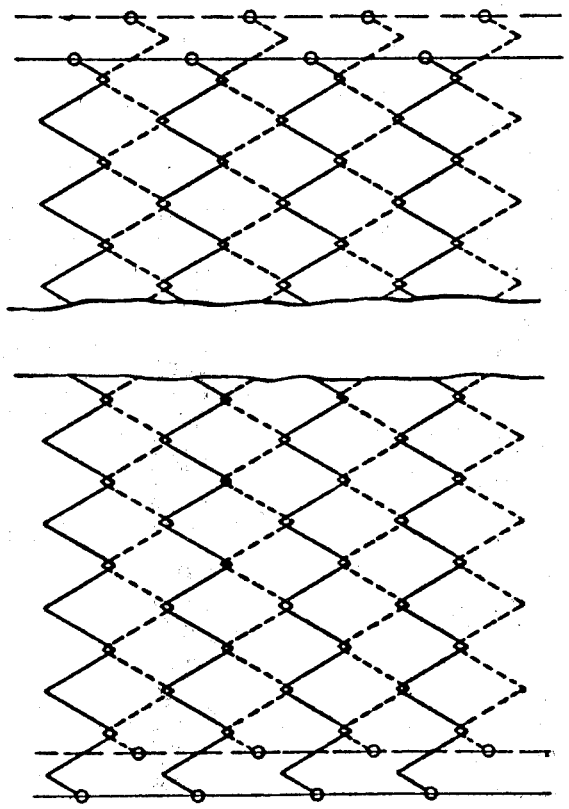
FIG. 9 is an explanatory view showing an unfavorable pattern which may be produced by the above apparatus.

Although the apparatus which has been described heretofore may produce complicated patterns, the apparatus is less than optimal in view of the following aspects. Namely, since the sewing machines mounted in two rows are operated simultaneously or synchronously, the comforter shows a lag of stitch pattern at the stitching-start position and at the stitching-finish position although no problem will virtually occur in-between. Furthermore, these sewing machines cannot be operated independently from the respective rows. FIG. 9 shows one of the stitch patterns formed by such an apparatus, wherein the solid line shows a stitch pattern formed by the front-row sewing machine, the broken line shows a stitch pattern formed by the rear-row sewing machine, the small circles shows the stitching start position and the stitching finished position.

This modification relates to an improvement of such apparatus which is substantially characterized in that the sewing machines in two rows can be operated synchronously as well as independently from respective rows, whereby the above mentioned disadvantage of the previous apparatus can be eliminated resulting in the stitching of patterns of further variations.

In this modification, such operation of the sewing machines is achieved by introducing the electromagnetic clutch (45) and (45') between the sewing machine drive shaft (24) and (24') and the power-operated motor (41) and subjecting the operation of the electro magnetic clutch (45) and (45') under the control of the NC device (51).

The above construction is hereinafter disclosed in detail in conjunction with attached drawings FIG. 10 and FIG. 11.

Figure 10:
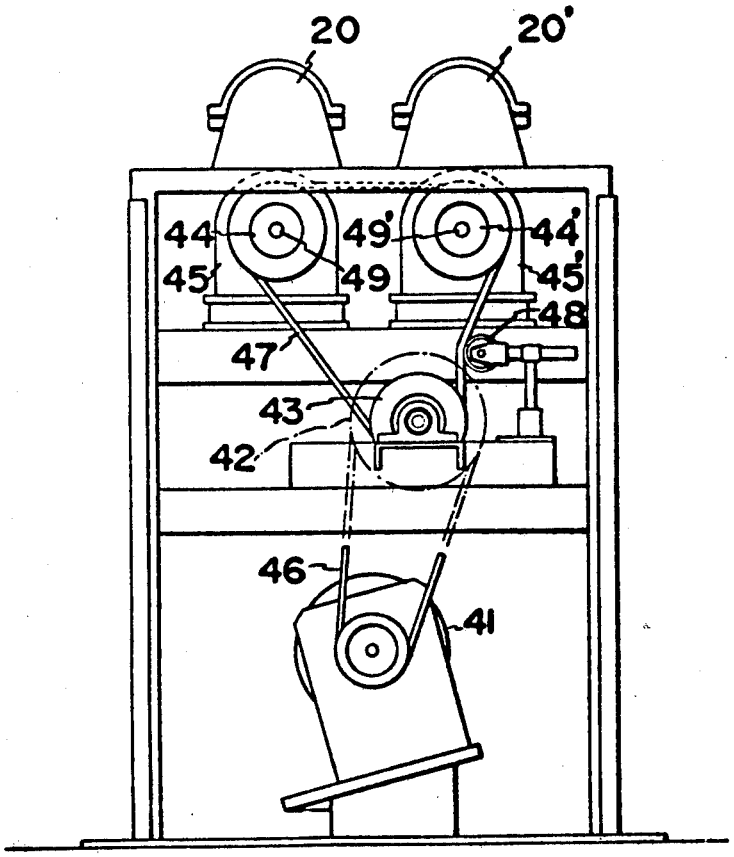
FIG. 10 is a side view of a modification of the apparatus of this invention showing the electro-magnetic clutches for regulating the needle drive shafts.

FIG. 10 shows the inside of the right support structure (3), wherein the electromagnetic clutches (45) and (45') have one end operably connected with the drive shaft (24) and (24') and the other end provided with clutch shafts (49) and (49'), while these clutch shafts (49) and (49') are driven by the power-operated motor (41) by way of pulleys (42), (43) and (44) and endless power-transfer belts (46) and (47). Numeral (48) indicates a tension roller for tightening the endless belt (47).

Figure 11:
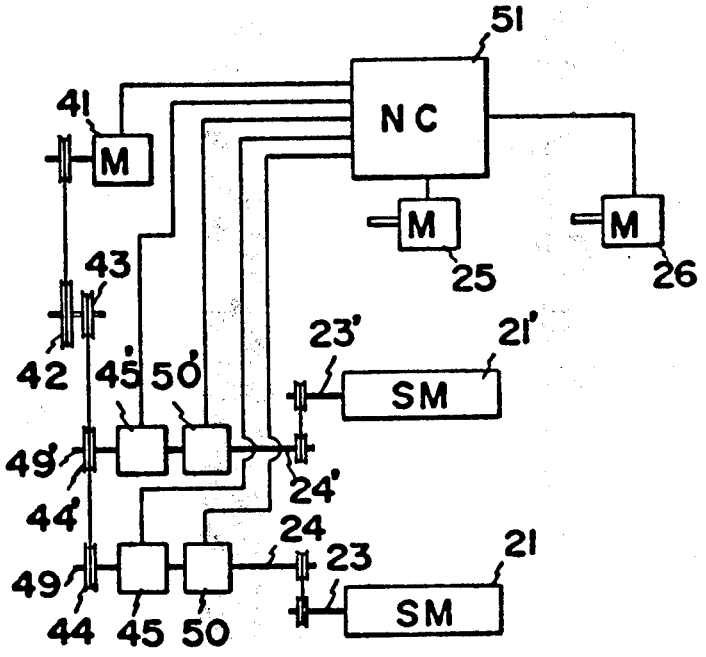
FIG. 11 is an explanatory view explaining the power connection of the drive mechanisms with the NC device.

FIG. 11 shows the power-connection of the sewing-machine drive mechanism schematically, wherein numeral (50) and (50') indicate electromagnetic brakes which may preferably be mounted between the sewing machines (21) and (21') and the electromagnetic clutches (45) and (45').

The manner in which the modified apparatus produces the comforters is hereinafter disclosed.

Before feeding the comforter material to the apparatus, the pattern to be stitched on the comforter is first designed using a multiple number of plants or plots, each of which is designated by the x abscissa (widthwise direction) and y ordinate (feeding direction) on the X-Y coordinate with the plotted data then fed into the NC (numerical control) device (51) as input.

In operation, the servo motors (25) and (26), the electromagnetic clutches (45) and (45') and the electromagnetic brakes (50) and (50') are actuated in accordance with the output signal delivered from the NC device (51). Namely, following the data output delivered from the NC device (51), the servo motor (25) rotates in either direction in order to shift the movable frame structure (5) transversely while the servo motor (26) rotates in either direction in order to impart the desired rotation to the rollers (8), (9) and (10) which cause the feeding of the comforter material. Furthermore, following the data output delivered from the NC device (51), the electromagnetic clutch (45) and (45') are also activated in order to operably connect the power-operated motor (41) with both or either of the sewing machines (26) and (26') arranged in two rows, whereby, in this modified apparatus, such sewing machines (26) and (26') in two rows can conduct the stitching operation either synchronously or independently from each other.

Due to the above simultaneous and cooperative operation of servo motors (25) and (26') and electromagnetic clutches (45) and (45'), which are all controlled by the NC device (51), the modified apparatus not only can automatically stitch a desired pattern on the surface of the produced comforter, but also can transversely align the stitching-start points and the stitching-finish points of respective sewing machines (26) and (26'), whereby the comforter as a product will posses a high commercial value.

Figure 12:
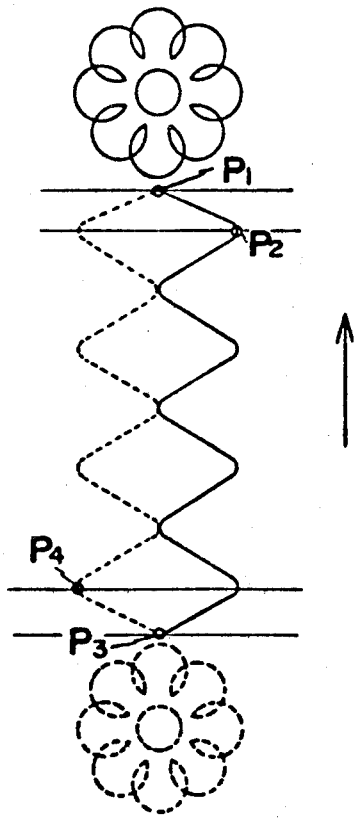
FIG. 12 is an explanatory view showing a pattern produced by the modified apparatus.
Figure 13:
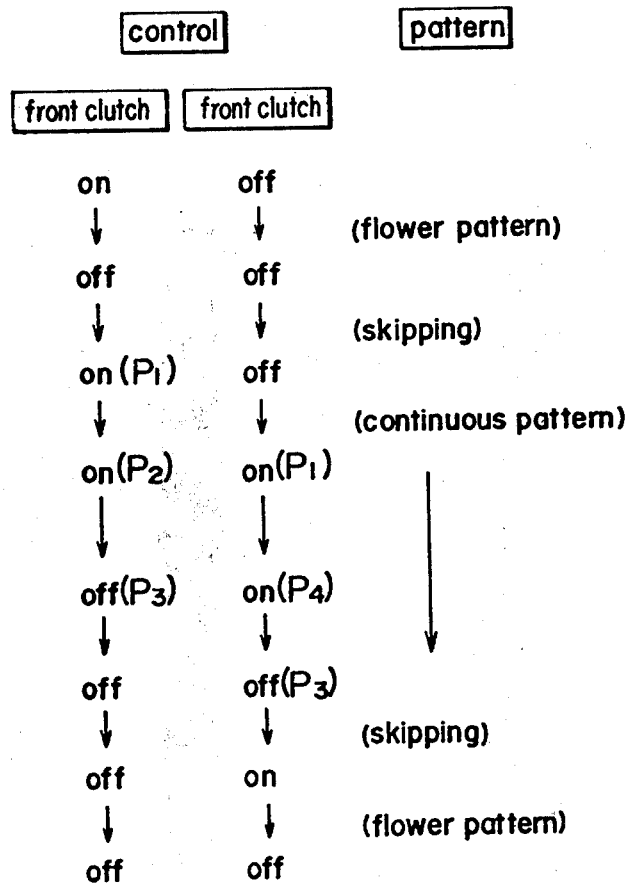
FIG. 13 is a flow chart showing the process of producing stitch patterns on the surface of the comforter according to the modified apparatus.

The stitching operation of the modified apparatus is further explained in view of FIG. 12 which shows two spaced-apart stitched flower patterns and two continuous stitched line patterns disposed between the flower patterns. In the drawing, the solid line indicates a pattern to be stitched by the front-row sewing machine (21), the broken line indicates a pattern to be stitched by the rear-row sewing machine (21'), while $P_1$ and $P_2$ are stitching-start points and stitching-finish points of each respective continuous patterns. Patterns per se are eventually formed by the transverse movement of the movable frame structure (4) and the feeding (returning) rotation of the lower rollers (8), (9) and (10), detailed explanation of the forming of each pattern is omitted. As shown in the flow chart of FIG. 13 primarily the clutch (45) for the front row is activated with the clutch (45') for the rear row inactivated in order to make only the front-row sewing machine (21) to stitch a pattern. Subsequently, both clutches (45) and (45') are inactivated and the conforter material is fed in a forward direction. When the sewing machine (21) comes just above point $P_1$, the machine (21) begins stitching a continuous line pattern. When the front-row sewing machine reaches point $P_2$, the clutch (45') for the rear row is activated and the rear-row sewing machine (21') begins stitching from point $P_2$. The stitching of the center portion of the continuous line patterns which ensues the above operation is conducted simaltaneously. When the front-row sewing machine (21) reaches point $P_3$, the clutch (45) for the front row is inactivated and only the rear-row sewing machine (21) continues stitching from point $P_4$ to $P_3$. Subsequently both clutches (45) and (45') are inactivated and the comforter material is successively fed in a forward direction skipping a predetermined distance. Finally, the rear-row clutch (45') is activated in order to make the rear-row sewing machine (21) stitch another flower pattern. In the above operation, when the clutches (45) and (45') are activated, corresponding electromagnetic brakes (50) and (50') are inactivated, and when the clutches (45) and (45') are inactivated, the brakes (50) and (50') are activated with the needles of the corresponding sewing machines placed in a raised position.

As has been described heretofore, according to this modified apparatus, the non-alignment of the stitching-start points and the stitching-finished points which is caused by the lag of needle positions of the front-row sewing machine and the rear-row sewing machine can be eliminated.

What we claim are:

1. Apparatus for automatically producing comforters comprising:

(a) two support structures transversely disposed in a parallel spaced-apart manner interposing a comforter material feeding path therebetween, (b) guide rails bridging said two support structures at a desired level above and parallel to a floor surface, said guide rails extending perpendicular to said feeding path;

(c) a movable frame structure slidably mounted on said guide rails in a transverse direction relative to said feeding path, said movable frame structure including feed roller means for feeding said comforter material along said feeding path, (d) a plurality of sewing machines stationarily disposed above said movable frame structure, said sewing machines being fixedly mounted on a transverse sewing-machine mounting frame which has both ends rigidly supported by said support structures, (e) a first drive mechanism including a first servo motor for moving said movable frame structure in a transverse direction, (f) a second drive mechanism including a second servo motor for driving said feed roller means in either a forward or a backward direction, and (g) a third drive mechanism including a power-operated motor for operating said sewing machines and further including electromagnetic clutch means and electromagnetic brake means interposed between said power-operated motor and said sewing machines.

2. Apparatus for automatically producing comforters according to claim 1, wherein said feed roller means comprises three pairs of rollers, said feeding of said comforter material conducted by interposing said material between each pair of said roller means.

3. Apparatus for automatically producing comforters according to claim 1, wherein said first drive mechanism comprises said first servo motor and a threaded shaft which has one end connected with said first servo motor and another end threadedly engaged with one transverse end of said movable frame structure.

4. Apparatus for automatically producing comforters according to claim 1, wherein said second drive mechanism comprises said second servo motor and an endless chain which operably connects said servo motor with said feed roller means.

5. Apparatus for automatically producing comforters according to claim 1, wherein said sewing machines are arranged in two rows.

6. Apparatus for automatically producing comforters according to claim 1, wherein said first and second servo motors are controlled by a numerical control device.

7. Apparatus for automatically producing comforters according to claim 1, wherein said first and second servo motors, said electro magnetic clutches and said electromagnetic brakes are all controlled by a numerical control device.

8. Apparatus for automatically producing comforters comprising:

(a) two support structures transversely disposed in a parallel spaced-apart manner interposing a comforter material feeding path therebetween, (b) guide rails bridging said two support structures at a desired level above and parallel to a floor surface, said guide rails extending perpendicular to said feeding path, (c) a movable frame structure slidably mounted on said guide rails in a transverse direction relative to said feeding path, said movable frame structure including feed roller means for feeding said comforter material along said feeding path, (d) a plurality of sewing machines stationarily disposed above said movable frame structure, said sewing machines being fixedly mounted on a transverse sewing-machine mounting frame which has both ends rigidly supported by said support structures, (e) a first drive mechanism including a first servo motor for moving said movable frame structure in a transverse direction, (f) a second drive mechanism including a second servo motor for driving said feed roller means in either a forward or a backward direction and further including an endless chain which operably connects said servo motor with said feed roller means, (g) a third drive mechanism including a power-operated motor for operating said sewing machines, and (h) a speed varying device disposed between said second servo motor and said feed roller means for varying the speed of said feed roller means.

* * * * *